US010003166B2

(12) United States Patent
Youtsey

(10) Patent No.: US 10,003,166 B2
(45) Date of Patent: Jun. 19, 2018

(54) UNIVERSAL COMPACT COMPRESSION TOOL

(71) Applicant: PCT International, Inc., Mesa, AZ (US)

(72) Inventor: Timothy L. Youtsey, Tempe, AZ (US)

( * ) Notice: Subject to any disclaimer, the term of this patent is extended or adjusted under 35 U.S.C. 154(b) by 149 days.

(21) Appl. No.: 15/293,012

(22) Filed: Oct. 13, 2016

(65) Prior Publication Data

US 2017/0104304 A1 Apr. 13, 2017

Related U.S. Application Data

(60) Provisional application No. 62/241,125, filed on Oct. 13, 2015.

(51) Int. Cl.
*H01R 43/048* (2006.01)
*H01R 43/042* (2006.01)

(52) U.S. Cl.
CPC ..... *H01R 43/048* (2013.01); *H01R 43/0425* (2013.01); *Y10T 29/53222* (2015.01); *Y10T 29/53226* (2015.01)

(58) Field of Classification Search
CPC ..... H01R 43/042; H01R 43/0421; H01R 43/0425; H01R 43/048; H01R 43/0488; Y10T 29/53209; Y10T 29/53213; Y10T 29/53222; Y10T 29/53226; Y10T 29/53235; Y10T 29/53257; Y10T 29/53265; Y10S 72/712
USPC ..... 72/409.13, 409.14
See application file for complete search history.

(56) References Cited

U.S. PATENT DOCUMENTS

| | | | |
|---|---|---|---|
| 4,932,091 | A | 6/1990 | Krzyzanski |
| 5,647,119 | A | 7/1997 | Bourbeau et al. |
| 5,934,137 | A | 8/1999 | Tarpill |
| 6,272,738 | B1 | 8/2001 | Holliday et al. |
| D455,325 | S | 4/2002 | Steiner |
| 6,820,326 | B1 | 11/2004 | Tarpill et al. |
| 6,948,234 | B1 | 9/2005 | Steiner |
| 7,120,997 | B2 | 10/2006 | Islam et al. |
| 7,210,327 | B1 | 5/2007 | Tarpill et al. |
| 7,299,543 | B2 | 11/2007 | Montena |
| 7,318,272 | B1 | 1/2008 | Steiner |
| 7,849,589 | B2 | 12/2010 | Morrow |
| 8,087,160 | B1 | 1/2012 | Tarpill et al. |
| 8,112,876 | B2 | 2/2012 | Xie et al. |

(Continued)

*Primary Examiner* — Peter DungBa Vo
*Assistant Examiner* — Joshua D Anderson
(74) *Attorney, Agent, or Firm* — Thomas W. Galvani, P.C.; Thomas W. Galvani

(57) ABSTRACT

A universal compact compression tool includes a vise assembly having different sets of jaws. The different sets of jaws are for holding different connectors during installation on a cable. A shaft on the tool is mounted to move between advanced and retracted positions with respect to the vise assembly. On the shaft, a plunger is mounted to move between first and second positions. In the first position of the plunger, the plunger is advanced on the shaft. In the second position of the plunger, the plunger is retracted on the shaft. The user sets the plunger in either the first or the second position depending on the type of connector to be installed on the cable. Once selected, and with the connector in the vise assembly, the user closes a lever of the tool to move the shaft to the advanced position, thereby applying the connector to the cable.

24 Claims, 11 Drawing Sheets

(56) References Cited

U.S. PATENT DOCUMENTS

| | | | | |
|---|---|---|---|---|
| 8,256,102 | B2 | 9/2012 | Sutter et al. | |
| 8,464,422 | B2 | 6/2013 | Holliday et al. | |
| 8,516,696 | B2 | 8/2013 | Chawgo | |
| 8,627,562 | B2 | 1/2014 | Sutter et al. | |
| 8,656,580 | B2 | 2/2014 | Steiner et al. | |
| 8,875,387 | B2 | 11/2014 | Youtsey | |
| 9,246,294 | B2 | 1/2016 | Chawgo et al. | |
| 9,509,111 | B1 * | 11/2016 | Liao | H01R 43/042 |
| 2006/0042346 | A1 | 3/2006 | Holliday et al. | |
| 2009/0293984 | A1 * | 12/2009 | Wang | H01R 43/0424 140/106 |
| 2010/0170090 | A1 * | 7/2010 | Rodrigues | H01R 4/20 29/861 |
| 2010/0180436 | A1 | 7/2010 | Youtsey | |
| 2010/0313412 | A1 | 12/2010 | Youtsey | |
| 2011/0041326 | A1 | 2/2011 | Xie et al. | |
| 2011/0154651 | A1 * | 6/2011 | Liu | H01R 9/05 29/750 |
| 2012/0090169 | A1 | 4/2012 | Natoli et al. | |
| 2016/0141820 | A1 * | 5/2016 | Williams | H01R 9/05 29/753 |

* cited by examiner

UNIVERSAL COMPACT COMPRESSION TOOL

CROSS-REFERENCE TO RELATED APPLICATIONS

This application claims the benefit of U.S. Provisional Application No. 62/241,125, filed Oct. 13, 2015, which is hereby incorporated by reference.

FIELD OF THE INVENTION

The present invention relates generally to audio-visual equipment, and more particularly to audio-visual installation tools.

BACKGROUND OF THE INVENTION

There are a variety of tools available to compress F-type coaxial connectors. Some tools are heavy and awkward to use. Others are large and cumbersome. Some tools do not hold a coaxial cable well, which can make application of the connector difficult. Other tools do an inadequate job aligning the connector with the cable and consequently provide an inferior seating of the connector on the cable. Some cables deform the connector when applying it to the cable.

Most tools are constructed to handle only one type or size of connector. As a result, professional installers are forced to carry many types of compression tools, or will use a few tools regardless of whether the tools are rated for the connector or not. Where installers carry many types of tools, it can be bulky, burdensome, and frustrating to carry, sort, select, and use the proper tool. Where installers carry only one tool or an improvised installation tool, the likelihood of a poor installation of the connector on the cable increases. An improved compression tool is needed.

SUMMARY OF THE INVENTION

A universal compact compression tool is useful for installing different types of connectors onto a cable. The tool includes a vise assembly having a first set of jaws and a different, second set of jaws. The different jaws hold different connectors during installation on a cable. A shaft on the tool is mounted to move between advanced and retracted positions with respect to the vise assembly. On the shaft, a plunger is mounted to move between first and second positions. In the first position of the plunger, the plunger is advanced on the shaft. In the second position of the plunger, the plunger is retracted on the shaft. The user sets the plunger in either the first or the second position depending on the type of connector to be installed on the cable. Once selected, and with the connector in the vise assembly, the user closes a lever of the tool to move the shaft to the advanced position, thereby applying the connector to the cable.

BRIEF DESCRIPTION OF THE DRAWINGS

Referring to the drawings.

DETAILED DESCRIPTION

Figure 1A:
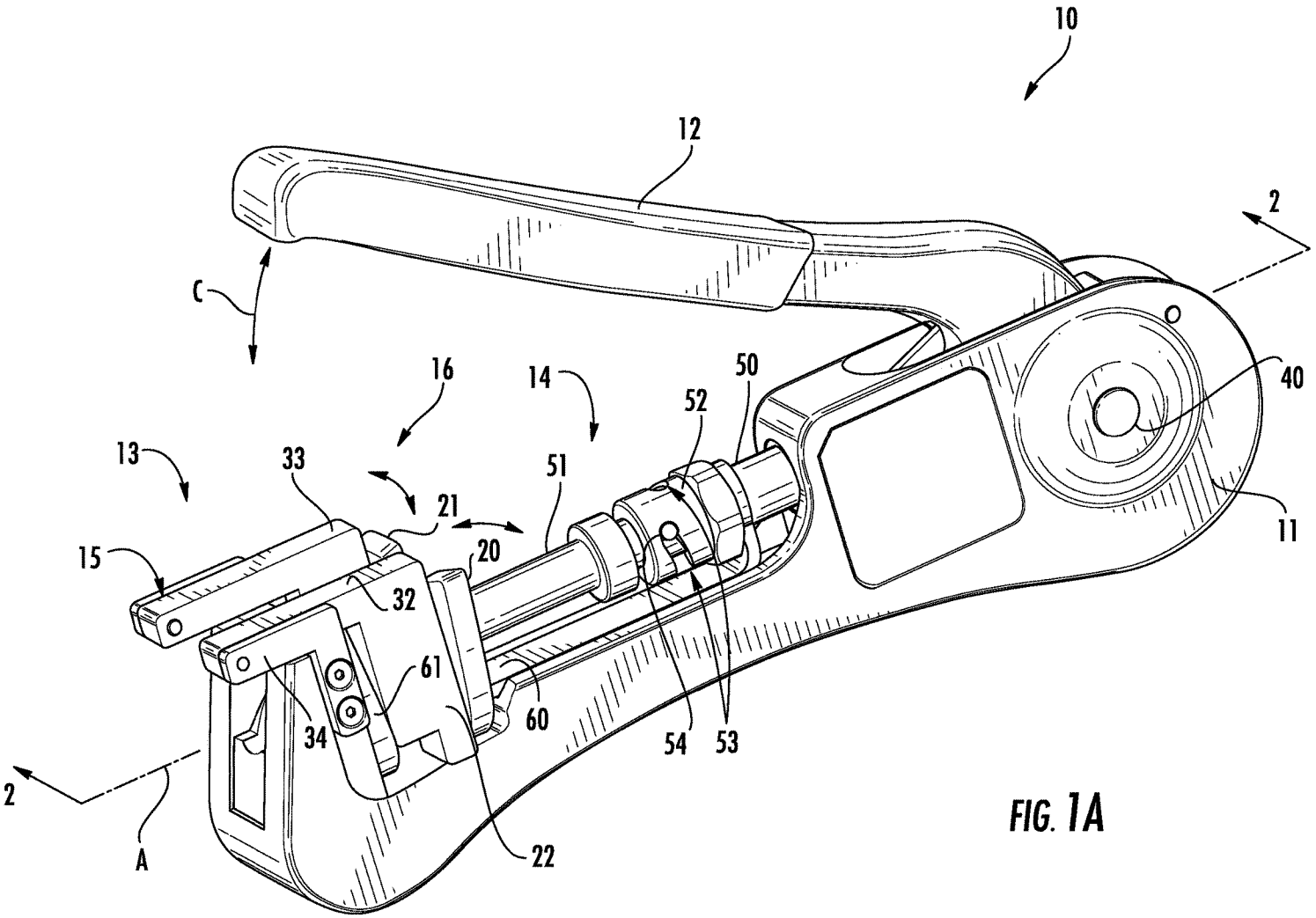
FIG. 1A is a side perspective view of a universal compact compression tool, including a body, a lever, a vise assembly having first and second jaw assemblies, and a ram having a plunger and shaft, the view showing the lever in an open position, the second jaw assembly in a ready position and open, and the plunger in an advanced position on the shaft.

Reference now is made to the drawings, in which the same reference characters are used throughout the different figures to designate the same elements. FIG. 1A illustrates a universal compact compression tool 10 useful for compressing and crimping different types of coaxial cable connectors onto a coaxial cable. The tool 10 is especially useful for crimping connectors of varying dimensions, such as different axial lengths or different diameters. The connector 10 includes a body 11 having a lever 12 at one end, a vise assembly 13 at an opposed end, and a ram 14 disposed therebetween along an axis A. The vise assembly 13 includes differently-sized sets of jaws for accepting, receiving, and holding differently-sized coaxial cables during compression of the connector in the tool 10 and onto a coaxial cable. The tool 10 thus enables a user to compress differently-sized connectors on cables quickly and without having to carry and change between multiple tools. Very generally, the lever 12 moves between a raised, or opened, position (as shown in FIG. 1A) and a lowered, or closed, position (as shown in FIGS. 1B and 1C) to actuate and advance the ram 14 axially into and against a connector disposed held in the vise assembly 13, so as to compress and crimp the connector on the cable.

Figure 2A:
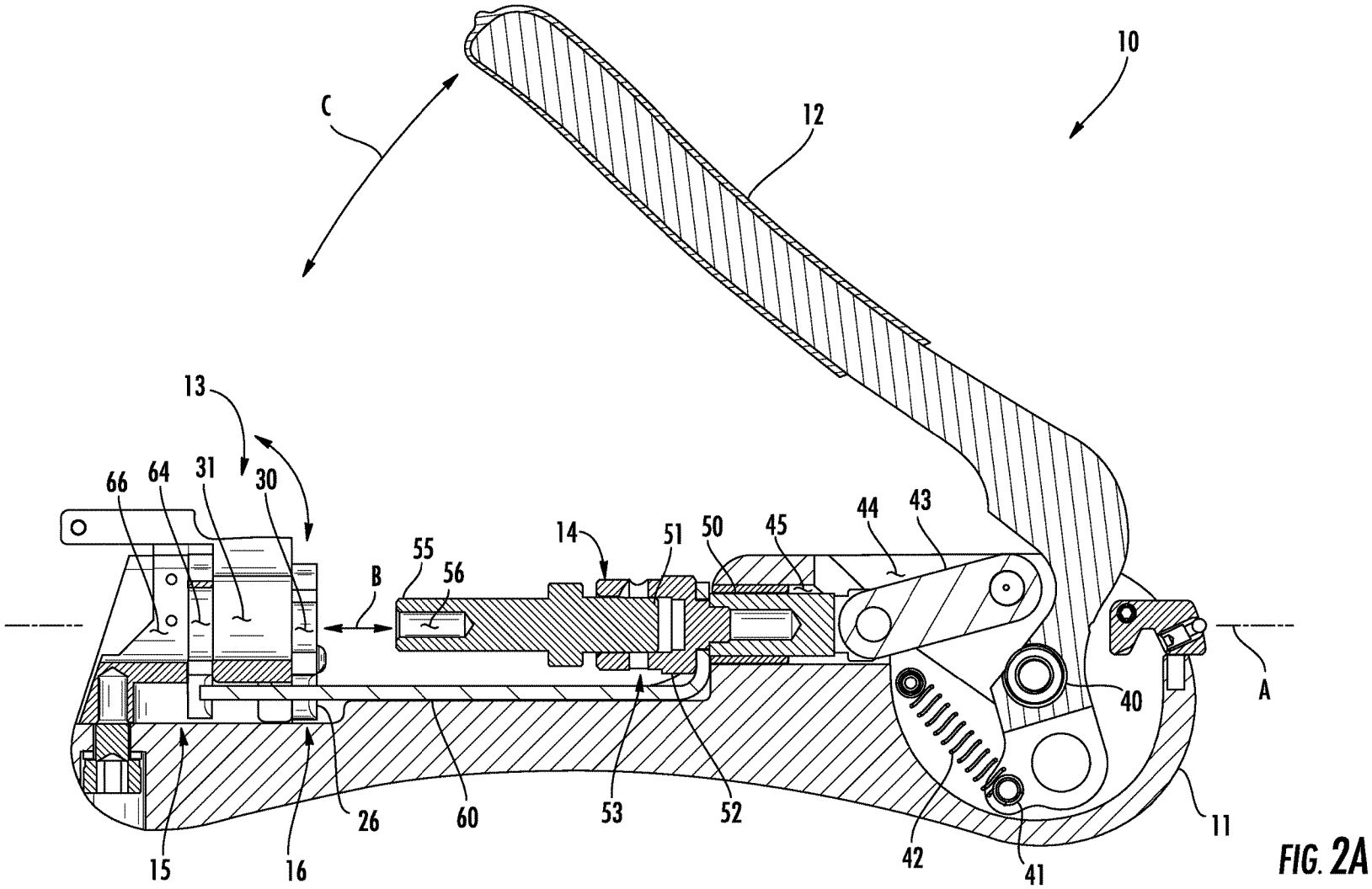
FIGS. 2A and 2B are section views of the tool of FIG. 1A, taken along the line 2-2 in FIG. 1A.
Figure 2B:
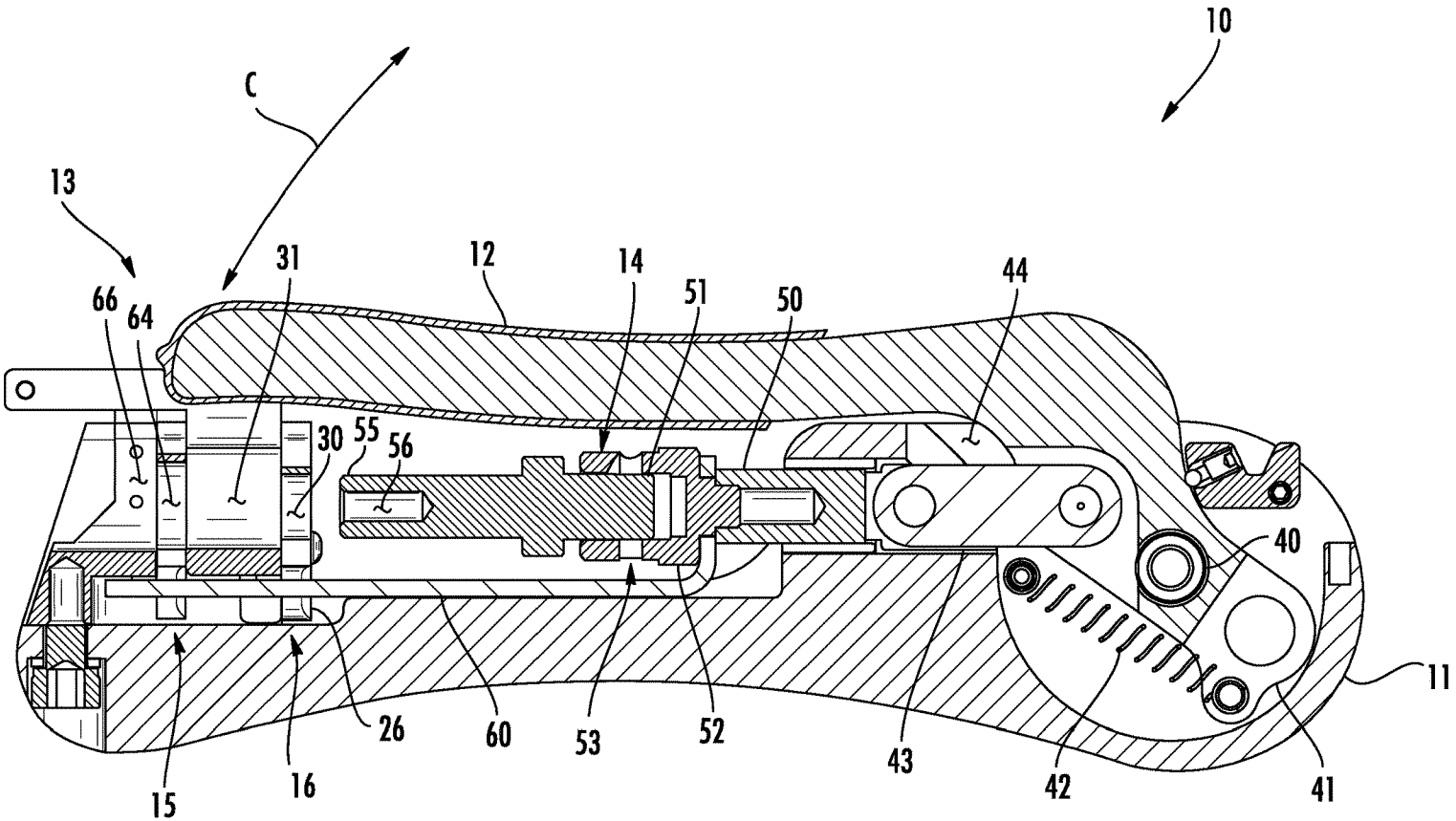
Figure 2C:
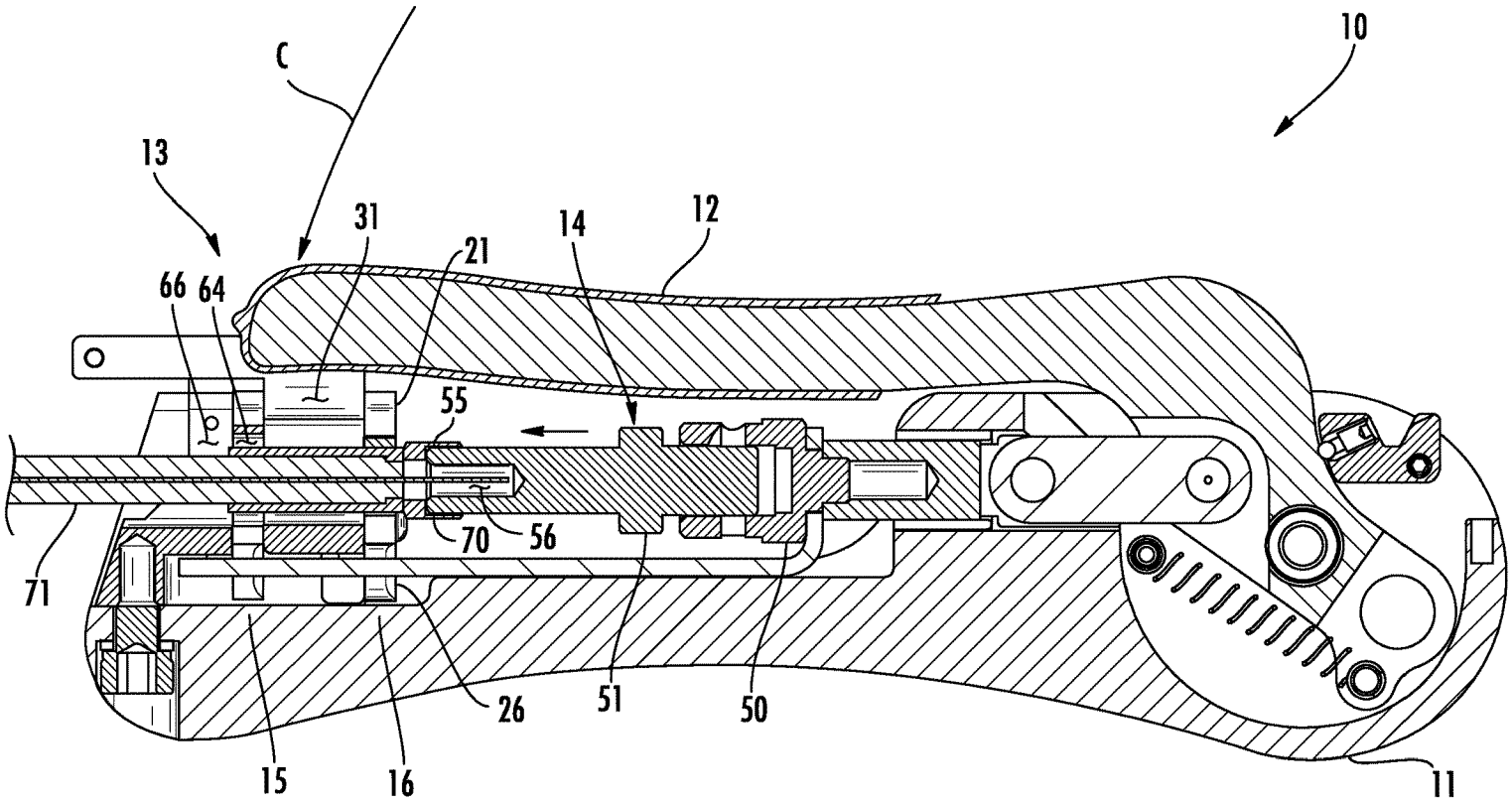
FIG. 2C is a section view similar to FIGS. 2A and 2B illustrating a connector being applied to a cable by the tool of FIG. 1A.
Figure 3A:
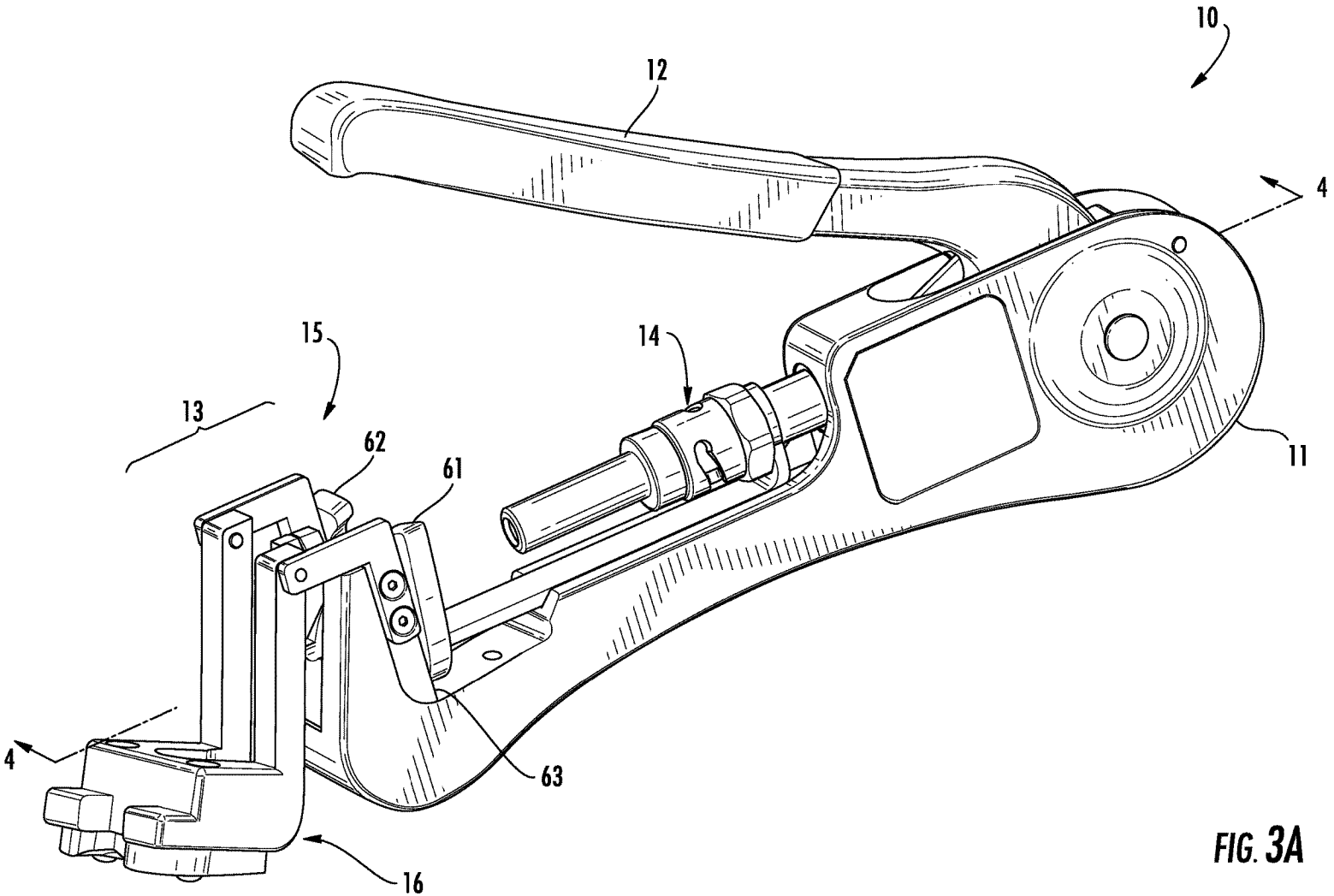
FIG. 3A is a side perspective view of the tool of FIG. 1A showing the lever in an open position, the second jaw assembly pivoted in an away position, the first jaw assembly in a ready position, and the plunger in a retracted position on the shaft.
Figure 3B:
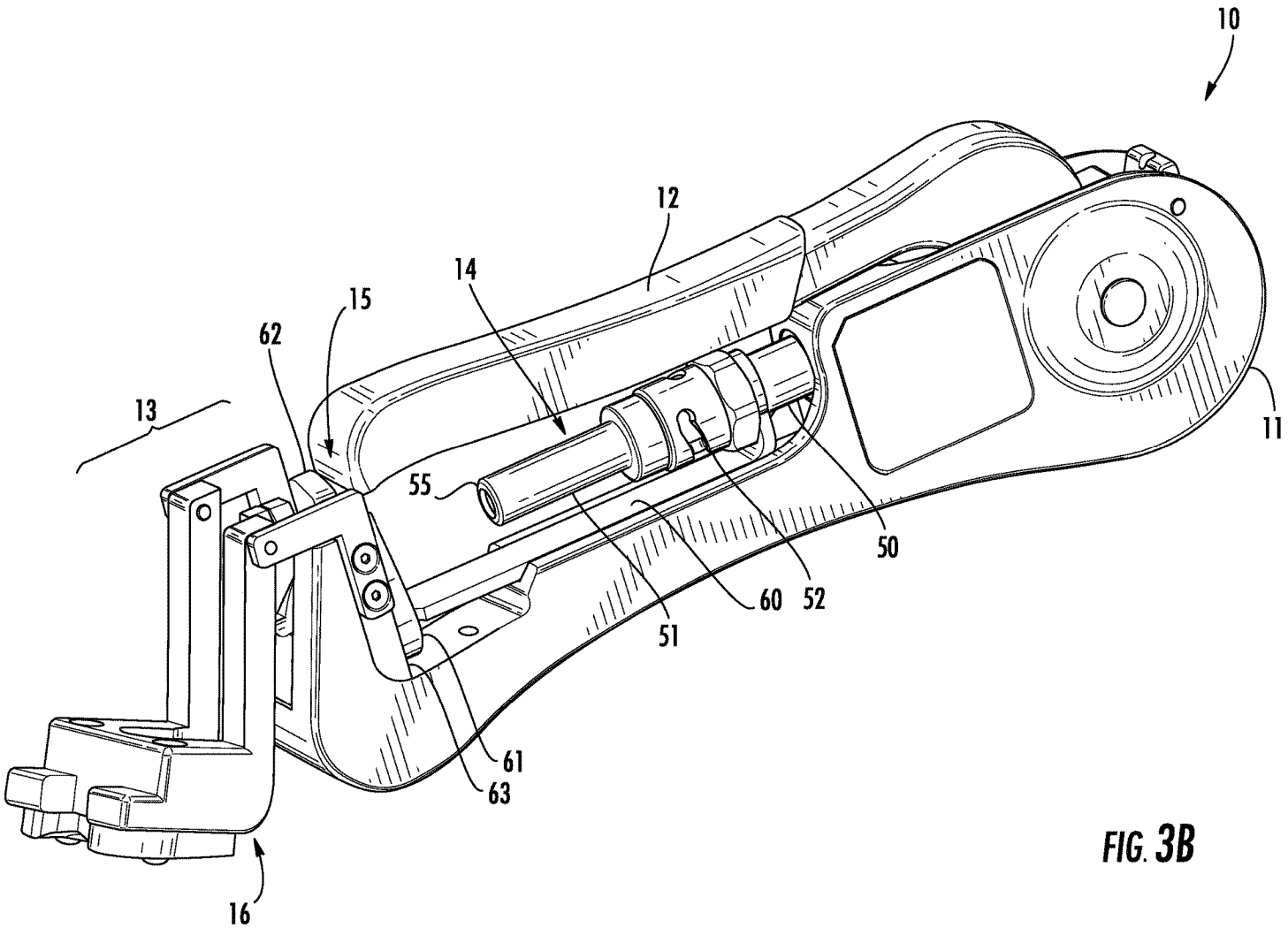
FIG. 3B is a side perspective views of the tool of FIG. 3A, showing the lever down, the first jaw assembly closed, and the ram advanced toward the first jaw assembly.

The vise assembly 13 includes two distinct first and second jaw assemblies 15 and 16, each including a set of jaws. The second jaw assembly 16 is closer to the ram 14 than the first jaw assembly 16, and the second jaw assembly 16 is pivoted to the body to swing between a position ready for use and a position out of the way of the operation of the first jaw assembly 15. FIGS. 1A-2C show the second jaw assembly 16 swung into position ready for use. FIGS. 3A-3C show the second jaw assembly 16 swung out of position, so that the first jaw assembly 15 is ready for use.

The first jaw assembly 15 is useful for larger-dimensioned connectors, and as such is considered to include a set of major jaws, while the second jaw assembly 16 is useful for smaller-dimensioned connectors and is considered to include a set of minor jaws. Generally, larger-dimensioned connectors have a longer axial length, while smaller-dimensioned connectors have a shorter axial length. However, in some connectors, the diameters and lengths vary inconsistently. The first and second jaw assemblies 15 and 16 accommodate both larger and smaller lengths and diameters of connectors.

Figure 1B:
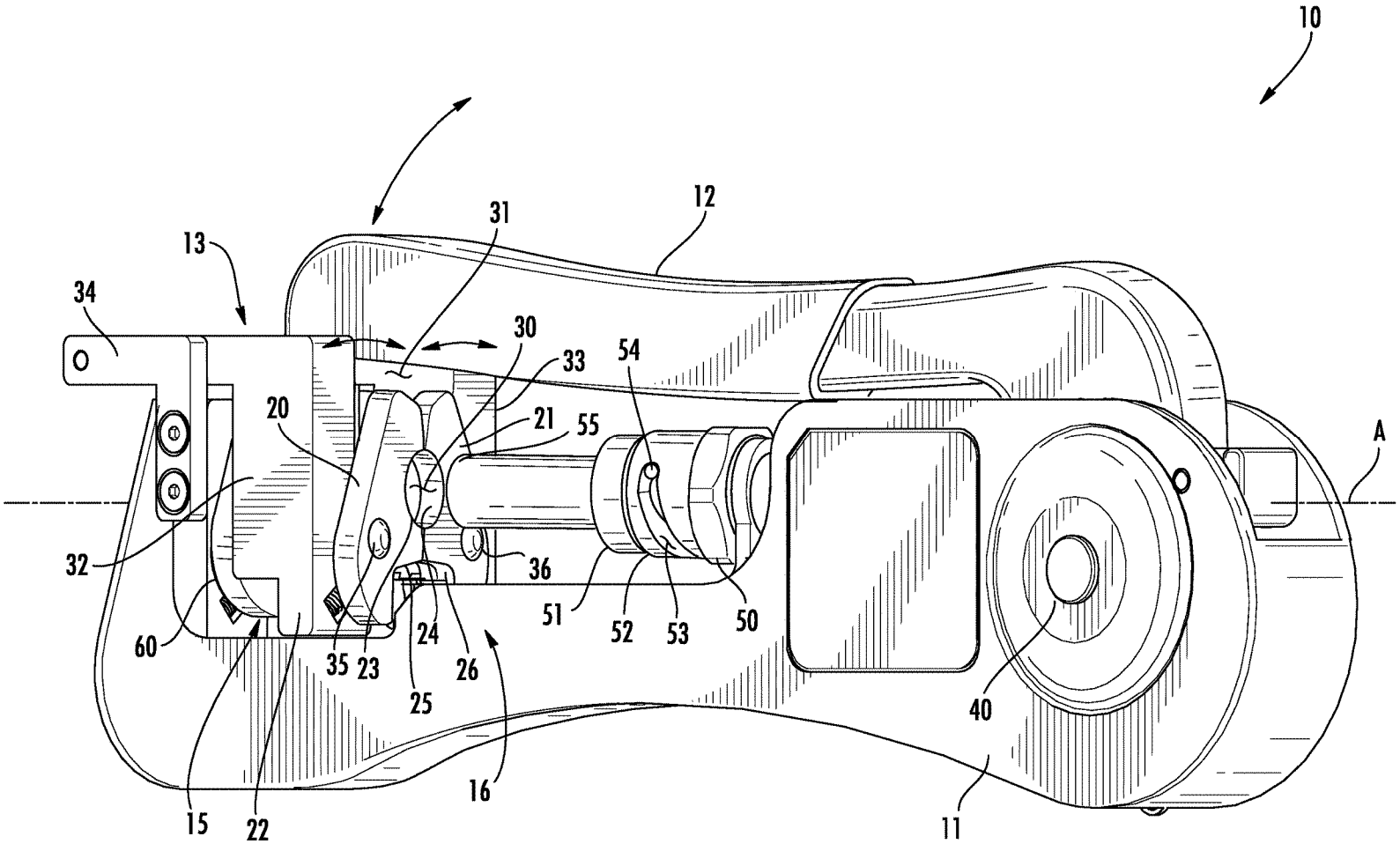
FIGS. 1B and 1C are rear and side perspective views, respectively, of the tool of FIG. 1A, showing the lever down, the second jaw assembly closed, and the ram advanced toward the second jaw assembly.
Figure 1C:
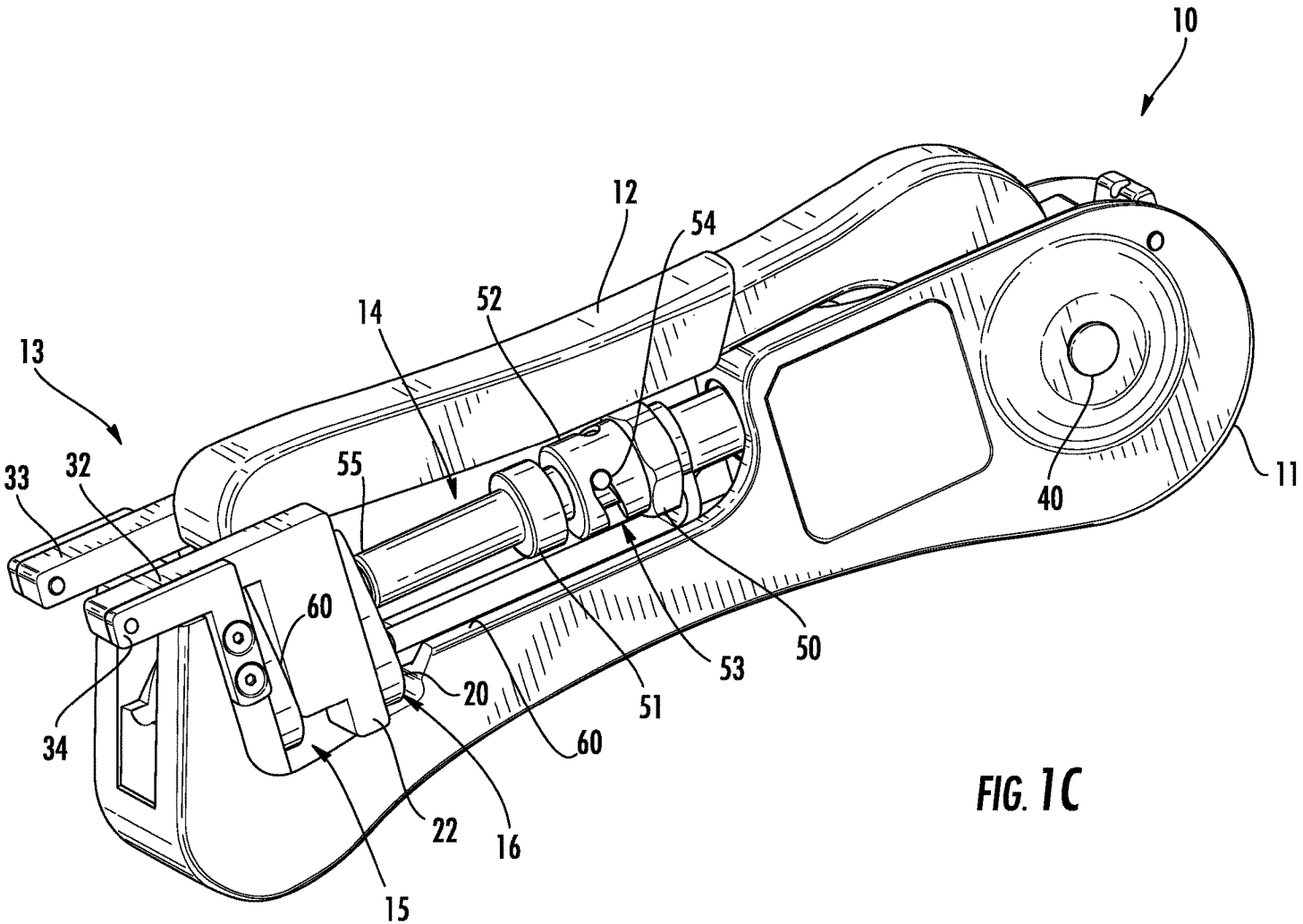

As seen in FIGS. 1A and 1B, the first jaw assembly 15 includes a pair of opposed jaws 20 and 21 mounted for pivotal movement and a gate 22 disposed proximate to the jaws 20 and 21. The jaws 20 and 21 are strong and rigid structures, formed with generally semi-circular inner contours 23 and 24, respectively, opposing the other. The jaws 20 and 21 pivot between an open position (shown in FIG. 1A), in which the jaws 20 and 21 are apart and from each other, to a closed position (shown in FIG. 1B), in which the jaws 20 and 21 are in contact with each other above and below the inner contours 23 and 24, and the inner contours 23 and cooperate to define a generally circular opening 30 for surrounding and holding a coaxial connector, thereby preventing the connector from dislodging from the tool 10 or moving away from the axis A. The jaws 20 and 21 are of any suitable thickness and are formed from a material or combination of materials having strong, rigid, hard, and durable material characteristics, such as metal. The jaws 20 and 21 are configured to provide a stable and uniform brace for the connector in the tool 10, so as to allow the connector to be registered and compressed properly, directly, and axially without deforming or damaging the connector. The jaws 20 and 21 further include lower abutment faces 25 and 26, respectively, below the inner contours 23 and 24. The abutment faces 25 and 26 are cams which impart pivotal movement to the jaws 20 and 21 in response to advancement of the ram 14 which moves in response to movement of the lever 12 from the open position to the closed position thereof.

Opposite the ram 14, behind the second jaw assembly 16, is a gate 22. The gate 22 is a block of material, such as metal, having a U-shaped opening 31 axially aligned with the opening 30 formed between the jaws 20 and 21. The opening 31 of the gate 22 is smaller than the opening 30 between the jaws 20 and 21, such that a connector may pass axially through the opening 30 in the jaws 20 and 21 but is prevented from further axial movement by the opening 31 in the gate 22. The opening 31 in the gate 22 is sufficiently large to allow the cable to which the connector is being applied to lay and be seated therein. The gate 22 is a block or surface against which the connector is compressed.

The gate 22 is pivotally mounted to the body 11 to swing into and out of alignment with the ram 14. The gate 22 includes two arms 32 and 33 which extend upward and rearwardly, toward an end of the body 11, where they are mounted for pivotal movement on pins to an L-shaped armature 34 that is rigidly fixed to the body 11. The gate 22 is pivoted to the end of the body 10 between a closed position, shown in FIGS. 1A-2C, and an open position, shown in FIGS. 3A-4C. In the open position of the gate 22 and the second jaw assembly 16, the gate 22 is pivoted away from the first jaw assembly 15, the second jaw assembly 16 is pivoted away from the first jaw assembly 15 and away from alignment with the plunger 51, and the second jaw assembly 16 thus exposes the first jaw assembly 15 such that the first jaw assembly 15 is directly aligned with the plunger 51 without interruption or any obstacles therebetween.

However, in the closed position of the gate 22, the gate 22 is pivoted and overlies the first jaw assembly 15. When the gate 22 is pivoted into the closed position, the gate 22 axially spaces apart the first and second jaw assemblies 15 and 16, which are aligned coaxially with each other and with the ram 14 and plunger 51, and are each parallel to the axis A. In this closed position of the gate 22 and the second jaw assembly 16, the gate 22 is pivoted down in front of the first jaw assembly 15, the second jaw assembly 16 is in front of the first jaw assembly 15, the first jaw assembly 15 is covered by the second jaw assembly 16, and the second jaw assembly 16 is directly aligned with the plunger 51 without interruption of any obstacles therebetween.

The jaws 20 and 21 are each mounted for pivotal movement to the front of the gate 22. Pins 35 and 36 are set into the gate 22 and extend toward the ram 14. The jaws 20 and 21 each include through-holes which receive pins 35 and 36. The jaws 20 and 21 thus pivot on the pins 35 and 36. Torsional springs carried on the pins 35 and 36 between the jaws 20 and 21 and the gate 22 bias the jaws 20 and 21 into the open position thereof.

The lever 12 is moved to the closed position to overcome the bias imparted by the torsional springs and thereby move the jaws 20 and 21 into the closed position thereof. Referring now to FIGS. 2A and 2B, which are section views taken along the line 2-2 in FIG. 1A, the lever 12 is shown in the open and closed positions, respectively. The lever 12 moves from the open, or raised, position to the closed, or lowered, position to drive the ram 14 forward along the double arrowed line B in FIG. 2A, toward the vise assembly 13. The lever 12 is operatively coupled to the ram 14 to impart reciprocal movement to the ram 14 between a retracted position (FIG. 2A) and an advanced position (FIG. 2B) with respect to the vise assembly 13.

The lever 12 is mounted for pivotal movement along double-arrowed line C on an axle 40 carried by the body 11. The lever 12 includes the long handle as well as an extension 41 opposite the handle. A longitudinal tension spring 42 is coupled to the body 11 and the extension 41 and biases the extension so that the lever 12 is biased into the open position thereof. A linkage 43 couples the lever 12 to the ram 14. The linkage 43 is mounted for free pivotal movement at one end to the lever 12 and at another end to the back of the ram 14. The linkage 43 transforms the cyclical pivotal movement of the lever 12 into reciprocal axial movement of the ram 14 along the line B. A channel 44 is defined in the body 11 proximate to the lever 12, and the lever 12 moves within that channel 44. Joined to the channel 44 is a bore 45 in which the ram 14 is carried. The linkage 43 extends between the channel 44 and the bore 45 and is captured therein, prevented from movement other than in the plane of the channel 44. When the lever 12 is in the open position, the linkage 43 is drawn back and the ram 14 is drawn back into the retracted position. When the lever 12 is in the closed position, the linkage 43 is forced forward and the ram 14 is pushed into the advanced position. The spring 42 pulls the lever 12 back to the open position, and thus, the ram 14 is biased back to the retracted position. In this way, the ram 14 is operatively coupled to the lever 12.

Still referring to FIGS. 2A and 2B, but also to FIG. 1A, the ram 14 is generally cylindrical and includes a cylindrical shaft 50 as well as a cylindrical plunger 51 mounted on the shaft. The shaft 50 is coupled to the linkage 43 and carried in the bore 45. The shaft 50 thus directly moves between advanced and retracted positions when the ram 14 as a whole moves between the advanced and retracted positions. The shaft is shown in the various drawings as a two-piece assembly; in other embodiments it is a single integral piece, and in others, it is made of multiple pieces. Mounted to the shaft 50 is the plunger 51. The plunger 51 is mounted to the shaft 50 to move between first and second indexed helical positions with respect to the shaft 50, which positions correspond to the dimension of the connector to be applied to the cable. The plunger 51 is the distal end of the ram 14, and thus can effectively make the ram 14 longer and shorter. FIGS. 1A, 2A, and 2B all show the plunger 51 in the first indexed position, making the ram 14 effectively longer.

Figure 4A:
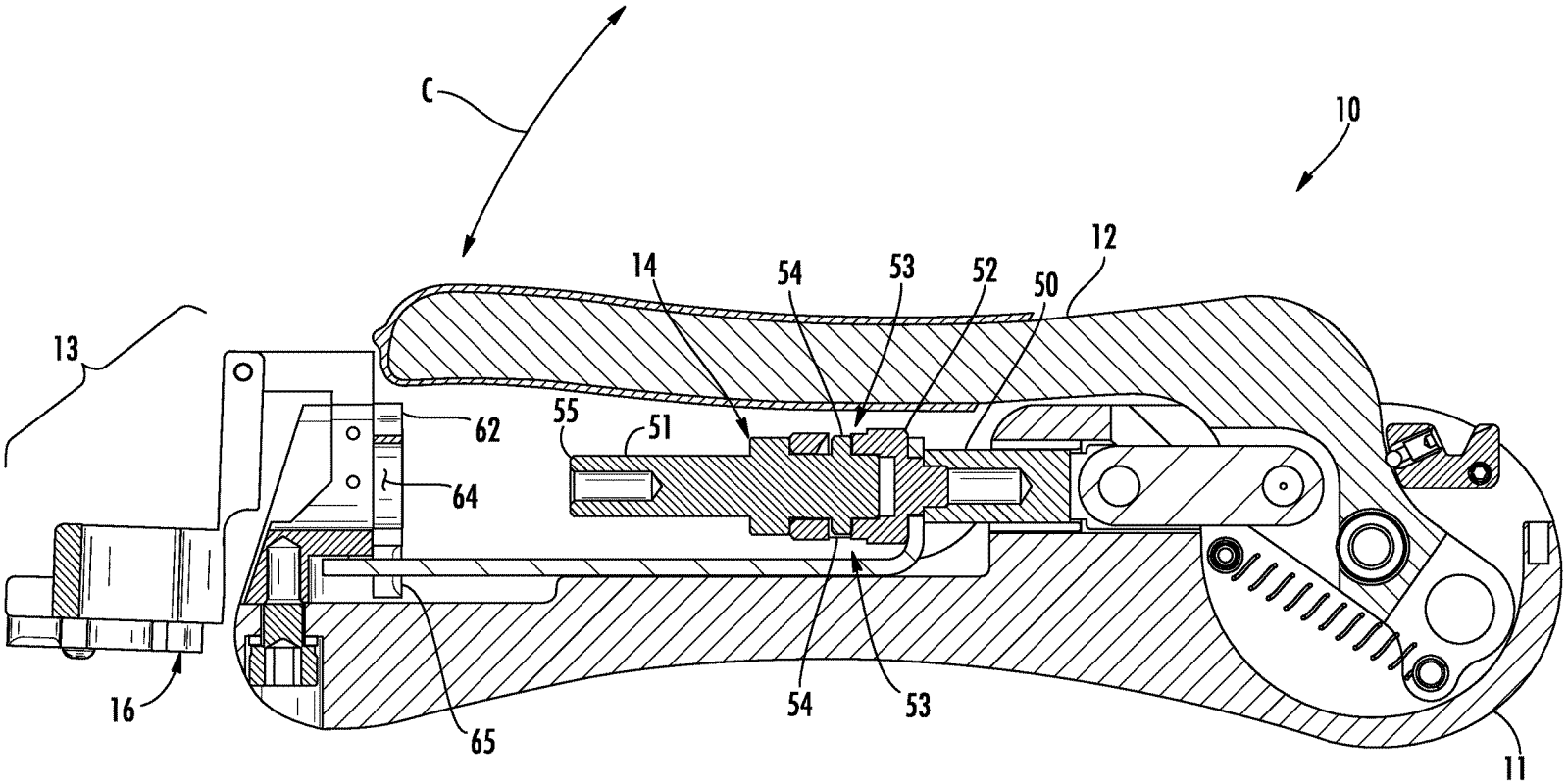
FIGS. 4A and 4B are section views of the tool of FIG. 3A, taken along the line 4-4 in FIG. 3A.
Figure 4B:
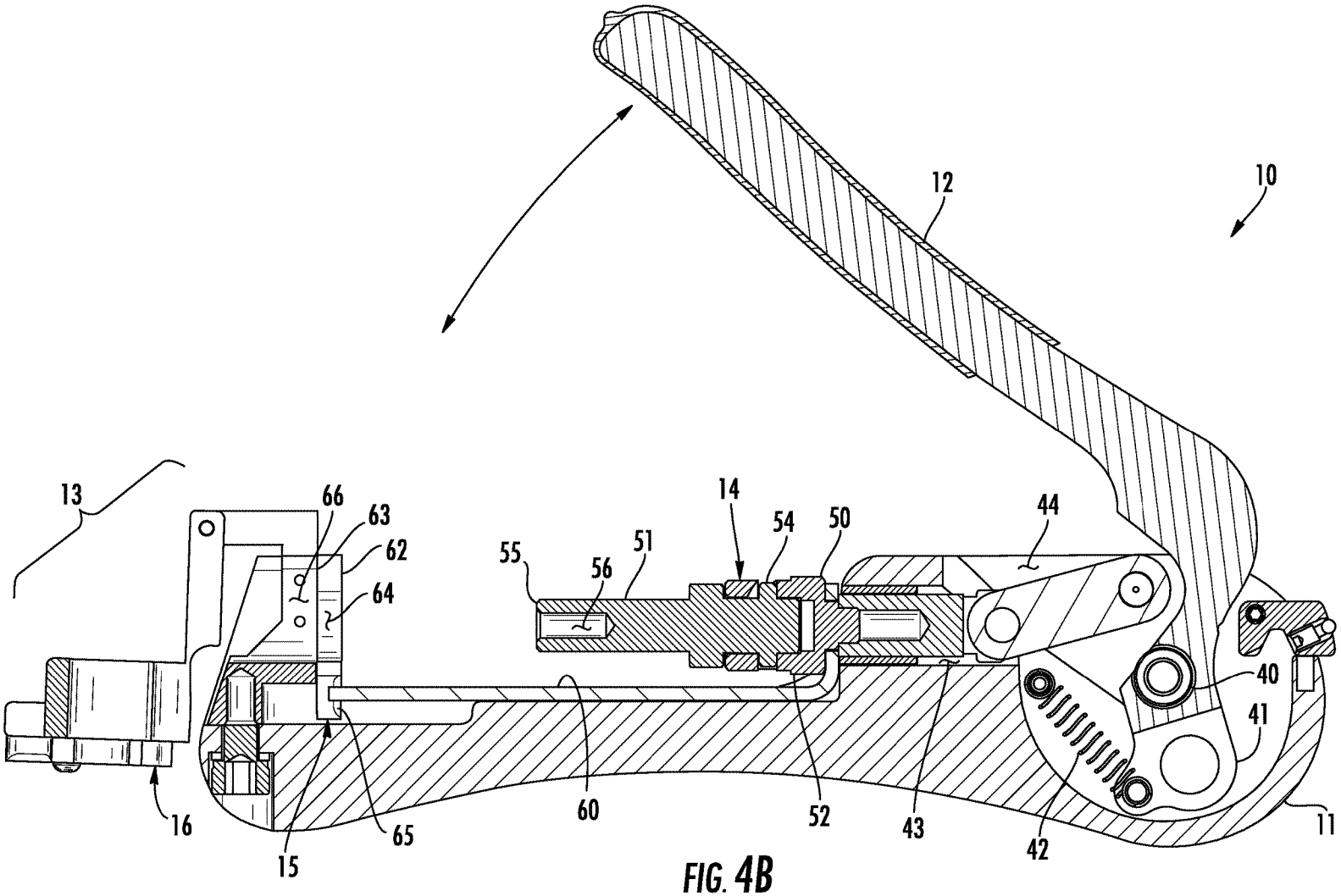

The plunger 51 is carried at the end of the shaft 50 and fit into an adjustment barrel 52. The adjustment barrel 52 is a hollow, open-ended cylinder formed with two helical slots 53 in its sidewall. The rear end of the plunger 51 is carried in the adjustment barrel 52 and includes two opposed, radially-extending pegs 54 that are received in the slots 53. Only a single peg 54 is visible in FIG. 1A, and the section views of FIGS. 2A and 2B do not show the pegs 53 since they are rotated out of the section. The pegs 54 guide movement of the plunger 51 with respect to the shaft 50; because the slots 53 are helical, axial movement of the plunger 51 between the first and second indexed positions is also rotational movement of the plunger 51 with respect to the shaft 50. Rotational movement of the plunger 51 with respect to the shaft 50 imparts axial movement of the plunger 51 with respect to the shaft 50, and conversely, axial movement of the plunger 51 with respect to the shaft 50 imparts rotational movement of the plunger 51 with respect to the shaft 50. The ends of the slots 53 are slightly shaped, enlarged and offset, such that when the pegs 54 reach said ends, the pegs 54 are stopped, snappedly engaged, and entrapped. This prevents the plunger 51 from accidentally coming loose with respect to the shaft 50 and moving out of the selected indexed position. This is especially useful when the plunger 51 is in the advanced position thereof, as illustrated in FIGS. 2A and 2B. Briefly, the section view of FIG. 4A illustrates the plunger 51 in the retracted position thereof; it can be seen there that the plunger 51 is further back in the ram 14, and the pegs 54 are disposed at the rear ends of the slots 53.

A distal end 55 of the plunger 51 is formed with a socket 56. The socket 56 is a cylindrical recess extending into the plunger 51 from the distal end 55. The socket 56 is sized and shaped to receive the center conductor of a conventional coaxial cable without crushing or otherwise damaging the center conductor.

Still referring primarily to FIGS. 2A and 2B, below the ram 14, a long rod 60 extends from the shaft 50 to under the vise assembly 13. The rod 60 is seated in a channel along the axis A of the tool 10 and reciprocates in that channel. The rod 60 is attached just behind the plunger 51, so that the rod 60 is unaffected by the adjustment and indexed positioning of the plunger 51 and maintains a length with respect to the shaft 50. The rod 60 has two tapered heads—a forward head and a rearward head—each with opposed cam surfaces. In the retracted position of the ram 14, the cam surfaces of both of the heads are away from the first and second jaw assemblies 15 and 16. However, when the ram 14 is in the advanced position thereof, the cam surfaces of both heads are advanced into contact with the first and second jaw assemblies 15 and 16 and cam the jaws of the first and second jaw assemblies 15 and 16 into pivotal movement. For example, when the ram 14 is in the advanced position thereof, the cam surfaces of the rearward head are advanced into contact with the abutment faces 25 and 26 of the jaws 20 and 21, respectively, to impart pivotal movement to the jaws 20 and 21 from the open position to the closed position. Likewise, the cam surfaces of the forward head are advanced into contact with abutment faces for the jaws of the first jaw assembly 15.

The first jaw assembly 15 is similar to the second jaw assembly 16 in many ways, but is useful for larger-dimensioned coaxial cable connectors. The first jaw assembly 15 is shown most clearly in FIGS. 3A-4C. The second jaw assembly 16 includes a pair of opposed jaws 61 and 62 mounted for pivotal movement to a gate 63. The jaws 61 and 62 are strong and rigid structures, each formed with a generally semi-circular inner contour opposing the other, like the inner contours 23 and 24. The jaws 61 and 62 pivot from an open position, shown in FIGS. 3A and 4B, in which the jaws 61 and 62 are apart from each, to a closed position, shown in FIGS. 3B, 4A, and 4C, in which the jaws 61 and 62 define a generally circular opening 64 for surrounding and holding a coaxial cable connector, thereby preventing the connector from dislodging from the tool 10 or moving away from the axis A. The jaws 61 and 62 are of any suitable thickness and are formed from a suitable material or combination of materials having strong, rigid, hard, and durable material characteristics, such as metal. The jaws 61 and 62 are configured to provide a stable and uniform brace for the connector in the tool 10, so as to allow the connector to be registered and compressed properly, directly, and axially without deforming or damaging the connector.

The jaws 61 and 62 include lower abutment faces. The lower abutment face of the jaw 62 is visible in FIGS. 4A-4C and marked with the reference character 65. The abutment faces 65 act as cams to impart pivotal movement to the jaws 61 and 62 in response to advancement of the plunger 51 which moves in response to movement of the lever 12 from the raised position to the lowered position thereof. As discussed above, the forward head of the rod 60 is tapered, and when the ram 14 is in the advanced position thereof, the cam surfaces of the forward head of the rod 60 are advanced into contact with the abutment faces 65 to impart pivotal movement to the jaws 61 and 62 from the open position to the closed position. When the lever 12 is released and the ram 14 slides back to the rearward position thereof, the cam surfaces of the forward head of the rod 60 move away from the abutment faces 65, and torsional springs urge the jaws 61 and 62 apart.

The jaws 61 and 62 are mounted to the gate 63. The gate 63 is a block rigidly mounted to the end of the body 10. The gate 63 has a U-shaped opening 66 axially aligned with the opening 64 formed between the jaws 61 and 62. The opening 66 of the gate 63 is smaller than the opening 64 between the jaws 61 and 62, such that a connector may pass axially through the opening 66 but is prevented from further axial movement by the opening 66 in the gate 63. The gate 63 is thus a block or surface against which the connector is compressed. The opening 66 in the gate 63 is sufficiently large to allow the cable to which the connector is being applied to lay and be seated therein. The opening 30 is smaller than the opening 64.

The jaws 61 and 62 are each mounted for pivotal movement to the front of the gate 63. Like the pins 35 and 36, pins are set into the gate 63 and extend toward the ram 14. The jaws 61 and 62 each include through-holes which receive the pins, and the jaws 61 and 62 thus pivot on the pins. Torsional springs carried on the pins between the jaws 61 and 62 and the gate 63 bias the jaws 61 and 62 into the open position thereof. The lever 12 is moved to the closed position to overcome the bias imparted by the torsional springs and thereby move the jaws 61 and 62 into the closed position thereof.

Figure 4C:
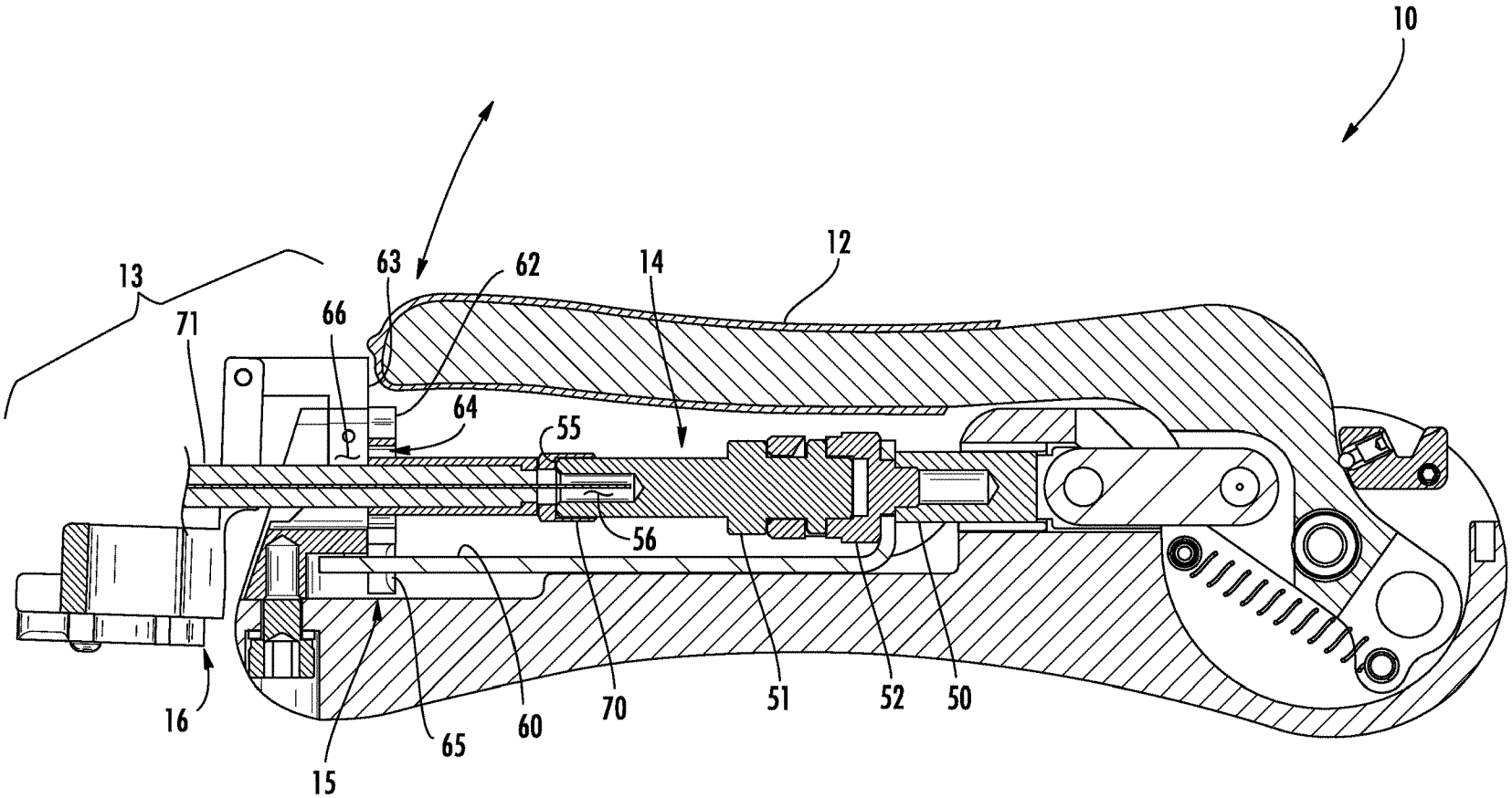
FIG. 4C is a section view similar to FIGS. 4A and 4B illustrating a connector being applied to a cable by the of FIG. 3A.

In operation, the tool 10 crimps and compresses a connector onto a cable. FIGS. 2C and 4C illustrate such a connector 70 on the ram 14 during compression. Referring first to FIG. 2A, however, the tool 10 is readied for use first by raising the lever 12. A user configures the tool 10 for the dimension of the connector selected to be applied to a cable. This involves adjusting the vise assembly 13 and adjusting the ram 14. First, if the user has selected a smaller-dimensioned connector, for example, the vise assembly 13 is adjusted so that the second jaw assembly 16 is pivoted down and ready for use. The second jaw assembly 16 is aligned along the axis A and registered with the distal end 55 of the plunger 51. The plunger 51 is then adjusted to the advanced position thereof, by rotating and moving the plunger 51 forwardly with respect to the shaft 50 until the pegs 54 lock into the ends of the slots 53. In this arrangement, the tool 10 is ready to crimp and compress a smaller-diameter connector onto a coaxial cable.

The cable and the connector are then readied according to conventional fashion. The cable is cut, stripped, and applied loosely into the back of a connector. The connector, with the cable extending out the back thereof, is then laid into the second jaw assembly 16. Because the second jaw assembly 16 is in front of the first jaw assembly 15, the cable extends through both the first and second jaw assemblies 15 and 16. The connector is placed between the inner contours 23 and 24 of the jaws 20 and 21, respectively, and is registered with the distal end 55 of the plunger 51, such that the center conductor of the cable is registered with the socket 56 formed into the distal end 55 of the plunger 51. Once so registered, the lever 12 is slowly moved to the closed position thereof.

Moving the lever 12 down to the closed position causes both the ram 14 and the rod 60 to advance toward the vise assembly 13. The cam surfaces on the rod 60 contact the abutment faces 25 and 26 of the jaws 20 and 21, respectively, to impart pivotal movement of the jaws 20 and 21 from the open position to the closed position. The jaws 20 and 21 close around and clamp the connector 70, which is maintained in the opening 47 by the closed jaws 20 and 21, to prevent lateral movement of the connector 70 out of the tool 10. Further lowering of the lever 12 imparts further forward movement of the ram 14. The plunger 51 moves into the connector 70, the socket 56 receives the center conductor of the connector 70, and the distal end 55 of the plunger 51 seats within the connector 70. The distal end 55 pushes into the connector 70 and thereby moves the connector 70 into confrontation with and against the gate 22. This further forward movement of the ram 14 causes the connector 70 to compress axially against the gate 22, thereby crimping onto the cable 71. The cable 71 extends through the openings 31 and 66. In a fully lowered position, the lever 12 itself is disposed partially in the opening 31 of the gate 22, as shown in FIG. 2C. In this way, a smaller-dimensioned connector 70 is applied to a cable 71. To remove the applied connector 70 and cable 71 from the tool 10, the lever 12 is merely brought back to the raised position, the ram 14 disengages from the connector 70, and the connector 70 and cable 71 are taken out of the openings 30 and 31.

A larger-dimensioned connector is applied to a cable in a similar way, though by using the first jaw assembly 15 rather than the second jaw assembly 16. FIG. 4C shows the second jaw assembly 15 pivoted out of the way to the open position thereof, so that the first jaw assembly 15 is directly opposed from the ram 14. The connector 70, already prepared with a cable as described above, is applied between the inner contours of the jaws 61 and 62, and the lever 12 is slowly lowered to the closed position. This causes both the ram 14 and the rod 60 to advance toward the first jaw assembly 15. The cam surfaces on the rod 60 contact the abutment faces 65 of the jaws 61 and 62, to impart pivotal movement of the jaws 61 and 62 from the open position to the closed position. The jaws 61 and 62 close and clamp around the connector 70, which is maintained in the opening 64 by the closed jaws 61 and 62, to prevent lateral movement of the connector 70 out of the tool 10. Further lowering of the lever 12 imparts further forward movement of the ram 14. The plunger 51 moves into the connector 70, the socket 56 receives the center conductor of the connector 70, and the distal end 55 of the plunger 51 seats within the connector 70. The distal end 55 pushes into the connector 70 and thereby moves the connector 70 into confrontation with and against the gate 63. This further forward movement of the ram 14 causes the connector 70 to compress axially against the gate 63, thereby crimping onto the cable 71. The cable 71 extends through the opening 66. In this way, a larger-dimensioned connector 70 is applied to a cable 71. To remove the applied connector 70 and cable 71 from the tool 10, the lever 12 is merely brought back to the raised position, the ram 14 disengages from the connector 70, and the connector 70 and cable 71 are taken out of the openings 64 and 66.

A preferred embodiment is fully and clearly described above so as to enable one having skill in the art to understand, make, and use the same. Those skilled in the art will recognize that modifications may be made to the described embodiment without departing from the spirit of the invention. To the extent that such modifications do not depart from the spirit of the invention, they are intended to be included within the scope thereof.

The invention claimed is:

1. A compression tool comprising:

a vise assembly including a first set of jaws and a different, second set of jaws, wherein the first set of jaws includes opposed major jaws mounted to pivot toward and away from each other in closed and open positions, respectively, and the second set of jaws includes opposed minor jaws mounted to pivot toward and away from each other in closed and open positions, respectively;

a shaft mounted for movement between an advanced position and a retracted position with respect to the vise assembly, wherein movement of the shaft from the retracted position to the advanced position thereby imparts movement to at least one of the first and second jaws from the open position to the closed position; and a plunger mounted to the shaft such that the plunger can move between first and second helical positions with respect to the shaft;

wherein in the first position of the plunger, the plunger is advanced a first distance with respect to the shaft; and in the second position of the plunger, the plunger is advanced a second distance with respect to the shaft, said second distance being different from the first distance.

2. The compression tool of claim 1, further comprising a lever operatively coupled to the shaft and the first and second sets of jaws to move the shaft between the advanced and retracted positions thereof in response to closing and opening the lever, respectively, thereby imparting movement to the at least one of the first and second sets of jaws between the closed position and the open position.

3. The compression tool of claim 2, wherein the lever is operatively coupled to close at least one of the first and second sets of jaws in response to closing the lever.

4. The compression tool of claim 1, wherein the plunger is formed with a socket at a distal end of the plunger.

5. The compression tool of claim 1, wherein the plunger moves in rotational movement on the shaft between the first and second positions.

6. The compression tool of claim 1, wherein the first and second sets of jaws are coaxial.

7. The compression tool of claim 6, wherein the first and second sets of jaws are axially spaced apart.

8. The compression tool of claim 1, wherein:

the second set of jaws is mounted for pivotal movement between a closed position and an open position;

in the closed position of the second set of jaws, the second set of jaws is in front of the first set of jaws and is directly aligned with the plunger; and in the open position of the second set of jaws, the second set of jaws is away from alignment with the plunger and the first set of jaws is directly aligned with the plunger.

9. A compression tool comprising:

a vise assembly configured to accommodate a first connector having a first dimension and a second connector having a different, second dimension;

the vise assembly comprising first and second sets of jaws, wherein the first set of jaws includes opposed major jaws mounted to pivot toward and away from each other in closed and open positions, respectively, and the second set of jaws includes opposed minor jaws mounted to pivot toward and away from each other in closed and open positions, respectively;

a shaft mounted for movement between an advanced position and a retracted position with respect to the vise assembly, wherein movement of the shaft from the retracted position to the advanced position thereby imparts movement to at least one of the first and second jaws from the open position to the closed position; and a plunger mounted to the shaft such that the plunger can move between first and second helical positions with respect to the shaft;

wherein in the first position of the plunger, the plunger is advanced a first distance with respect to the shaft corresponding to the first dimension; and in the second position of the plunger, the plunger is advanced a second distance with respect to the shaft corresponding to the second dimension.

10. The compression tool of claim 9, further comprising a lever operatively coupled to the shaft and the first and second sets of jaws to move the shaft between the advanced and retracted positions thereof in response to closing and opening the lever, respectively, thereby imparting movement to the at least one of the first and second sets of jaws between the closed position and the open position.

11. The compression tool of claim 10, wherein the lever is operatively coupled to close at least one of the first and second sets of jaws in response to closing the lever.

12. The compression tool of claim 9, wherein the plunger is formed with a socket at a distal end of the plunger.

13. The compression tool of claim 9, wherein the plunger moves in rotational movement on the shaft between the first and second positions.

14. The compression tool of claim 9, wherein the first and second sets of jaws are coaxial.

15. The compression tool of claim 14, wherein the first and second sets of jaws are axially spaced apart.

16. The compression tool of claim 9, wherein:

the second set of jaws is mounted for pivotal movement between a closed position and an open position;

in the closed position of the second set of jaws, the second set of jaws is in front of the first set of jaws and is directly aligned with the plunger; and in the open position of the second set of jaws, the second set of jaws is away from alignment with the plunger and the first set of jaws is directly aligned with the plunger.

17. A tool for compressing a connector onto a coaxial cable, the tool comprising:

a vise assembly comprising a first set of jaws and a different, second set of jaws, wherein the first set of jaws includes opposed major jaws mounted to pivot toward and away from each other in closed and open positions, respectively, and the second set of jaws includes opposed minor jaws mounted to pivot toward and away from each other in closed and open positions, respectively;

a shaft mounted for reciprocal movement between advanced and retracted positions with respect to the vise assembly, wherein movement of the shaft from the retracted position to the advanced position thereby imparts movement to at least one of the first and second sets of jaws from the open position to the closed position;

a plunger for compressing the connector in the vise assembly, the plunger mounted to the shaft such that the plunger can move between a first helical position and a second helical position on the shaft;

in the first position of the plunger and the advanced position of the shaft, the plunger is a first distance away from the vise assembly; and in the second position of the plunger and the advanced position of the shaft, the plunger is a second distance away from the vise assembly, the first and second distances being different.

18. The compression tool of claim 17, further comprising a lever operatively coupled to the shaft and the first and second sets of jaws to move the shaft between the advanced and retracted positions thereof in response to closing and opening the lever, respectively, thereby imparting movement to the at least one of the first and second sets of jaws between the closed position and open position.

19. The compression tool of claim 18, wherein the lever is operatively coupled to close at least one of the first and second sets of jaws in response to closing the lever.

20. The compression tool of claim 17, wherein the plunger is formed with a socket at a distal end of the plunger.

21. The compression tool of claim 17, wherein the plunger moves in rotational movement on the shaft between the first and second positions.

22. The compression tool of claim 17, wherein the first and second sets of jaws are coaxial.

23. The compression tool of claim 22, wherein the first and second sets of jaws are axially spaced apart.

24. The compression tool of claim 17, wherein:

the second set of jaws is mounted for pivotal movement between a closed position and an open position;

in the closed position of the second set of jaws, the second set of jaws is in front of the first set of jaws and is directly aligned with the plunger; and in the open position of the second set of jaws, the second set of jaws is away from alignment with the plunger and the first set of jaws is directly aligned with the plunger.

* * * * *